United States Patent [19]

VanRens et al.

[11] Patent Number: 4,593,739

[45] Date of Patent: Jun. 10, 1986

[54] METHOD OF AND APPARATUS FOR PACKING SAND AROUND A MOLD PATTERN BY VIBRATION

[75] Inventors: Russell J. VanRens, West Allis; Frank V. Bailey, Racine, both of Wis.

[73] Assignee: Outboard Marine Corporation, Waukegen, Ill.

[21] Appl. No.: 567,330

[22] Filed: Dec. 30, 1983

[51] Int. Cl.[4] ..... B22C 5/12; B22C 9/04; B22C 15/10

[52] U.S. Cl. ..... 164/34; 164/39; 164/192; 164/194; 164/203; 366/114

[58] Field of Search ..... 164/34, 35, 36, 39, 164/203, 194, 192, 206; 366/114

[56] References Cited

U.S. PATENT DOCUMENTS

| | | | |
|---|---|---|---|
| 1,113,626 | 10/1914 | Heller . | |
| 1,127,471 | 2/1915 | MacDonald | 164/192 |
| 1,962,734 | 6/1934 | Dupre | 164/192 X |
| 2,071,373 | 2/1937 | Wurzbach et al. | 366/114 X |
| 2,756,973 | 7/1956 | Dostatni | 366/114 X |
| 2,893,079 | 7/1959 | Moran et al. | 164/165 |
| 2,988,789 | 6/1961 | Taccone . | |
| 3,007,216 | 11/1961 | Johnston . | |
| 3,620,508 | 11/1971 | Lea | 164/39 X |
| 4,181,171 | 1/1980 | Yonemitsu . | |
| 4,454,906 | 6/1984 | Musschoot | 164/39 X |

FOREIGN PATENT DOCUMENTS

| | | | |
|---|---|---|---|
| 53-92332 | 8/1978 | Japan | 164/39 |
| 349560 | 5/1931 | United Kingdom . | |
| 531791 | 1/1941 | United Kingdom . | |
| 650466 | 2/1951 | United Kingdom . | |
| 712276 | 7/1954 | United Kingdom . | |
| 738981 | 10/1955 | United Kingdom . | |
| 1130036 | 10/1968 | United Kingdom . | |
| 1342691 | 1/1974 | United Kingdom . | |
| 1452255 | 10/1976 | United Kingdom . | |
| 406624 | 6/1974 | U.S.S.R. | 164/203 |

*Primary Examiner*—Nicholas P. Godici
*Assistant Examiner*—J. Reed Batten, Jr.
*Attorney, Agent, or Firm*—Michael, Best & Friedrich

[57] ABSTRACT

A mold pattern is held in position in a mold flask in an unconnected relation to the mold flask. Sand is supplied to the mold flask to surround the mold pattern while the mold flask is vibrated to compact the sand around the mold pattern.

16 Claims, 1 Drawing Figure

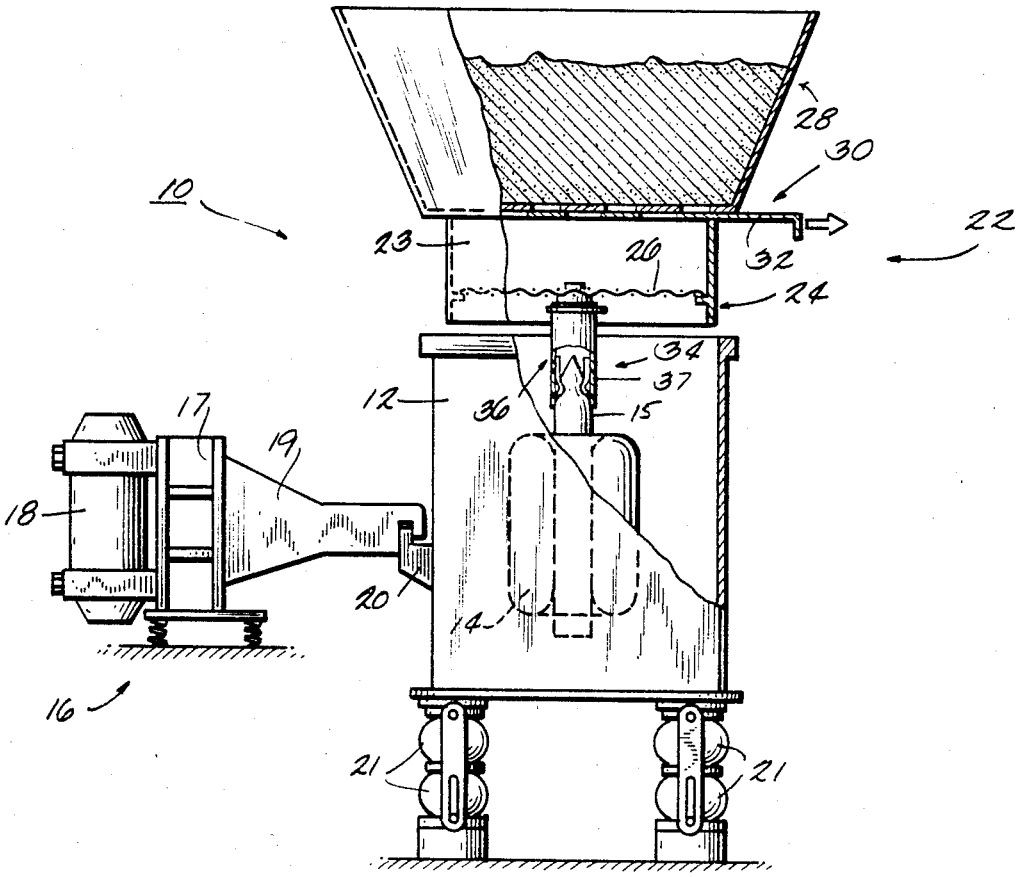
10
28
30
22
23
26
32
24
34
37
12
36
15
17
19
18
20
14
16
21
21

METHOD OF AND APPARATUS FOR PACKING SAND AROUND A MOLD PATTERN BY VIBRATION

RELATED APPLICATION

Reference is made to copending U.S. patent application Ser. No. 568,051, filed on Jan. 4, 1985, entitled "Molding Apparatus and Process Including Sand Compaction System".

BACKGROUND OF THE INVENTION

The invention relates to a molding or casting process, and more particularly to a process for inserting a foam mold pattern into a mold flask, and for compacting sand about the foam mold pattern.

In a lost foam casting process, the mold pattern which forms the desired molding cavity in the sand is a foam mold pattern that vaporizes when contacted by molten metal so that it need not be removed from the sand before casting. Since it is not necessary to remove the foam mold pattern from the sand before casting, the mold flask need not be separable into two parts, the cope and the drag, and the mold pattern can have a more complicated configuration than with conventional cope and drag flasks.

A lost foam casting process includes the steps of placing the foam mold pattern in the mold flask, compacting sand around the mold pattern, and pouring molten metal into the foam mold pattern. The molten metal causes the foam mold pattern to vaporize, and when the metal cools, the casting is removed from the sand.

Because the sand must be tightly compacted around the mold pattern in the flask, and because of the complicated mold pattern configurations permissible with a lost foam casting process, it is desirable to have a process which will compact the sand around the mold pattern to high sand pressure.

Prior processes for compacting sand around a foam mold pattern in a mold flask include the step of filling the mold flask with sand before vibrating the sand to compact it around the mold pattern.

Prior processes also include the steps of depositing sand into the mold flask through tubes extending downwardly into the mold flask, and shaking the mold flask with vertical vibrational forces while filling the mold flask with sand.

Attention is directed to the following U.S. Pat. Nos. which relate to the field of the present invention.

| Patentee | U.S. Pat. No. | Issued |
|---|---|---|
| Yonemitsu | 4,181,171 | Jan. 1, 1980 |
| Johnston | 3,007,216 | Nov. 7, 1961 |
| Taccone | 2,988,789 | June 20, 1961 |
| Moran et al. | 2,893,079 | July 7, 1959 |
| Dupre | 1,962,734 | June 12, 1934 |
| Heller | 1,113,626 | October 13, 1914 |
| MacDonald | 1,127,471 | February 9, 1915 |

SUMMARY OF THE INVENTION

The invention provides a process for inserting a mold pattern into sand for casting, the process comprising the steps of holding a mold pattern in a mold flask, depositing sand in a rainfall into the mold flask to surround the mold pattern, and shaking the mold flask to compact the sand around the mold pattern while the sand is being deposited into the mold flask.

In one embodiment, the step of depositing sand in a rainfall includes the step of distributing the sand evenly across the mold flask at a controlled velocity.

In one embodiment, the mold flask, when containing sand, has a combined center of gravity, and the mold flask is shaken as a whole body by horizontal vibrational forces directed in a horizontal plane extending approximately through the combined center of gravity.

In one embodiment, the mold pattern is held in the mold flask by means attached to the distribution box and releasably clamped to the mold pattern.

The invention also provides a molding apparatus comprising a mold flask adapted to contain a mold pattern and sand, means for holding a mold pattern in position in the mold flask, means for depositing sand in a rainfall into the mold flask to surround the mold pattern, and means for shaking the mold flask to compact the sand around the mold pattern while the sand is being deposited into the mold flask.

In one embodiment, the mold flask, when containing sand, has a combined center of gravity, and the means for shaking the mold flask shakes the mold flask as a whole body and provides horizontal vibrational forces directed in a horizontal plane extending approximately through the combined center of gravity.

In one embodiment, the means for depositing sand in a rainfall distributes sand evenly across the mold flask at a controlled velocity.

In one embodiment, the means for depositing sand in a rainfall includes a distribution box positioned above the mold flask, and the means for holding the mold pattern includes means attached to the distribution box and releasably clamped to the mold pattern.

In one embodiment, the distribution box has a bottom end and the means for distributing sand is a screen in the bottom end.

In one embodiment, the molding aparatus further comprises a batch hopper positioned above the distribution box, the batch hopper being adapted to contain sand and including selectively operable means for depositing sand into the distribution box.

A principal feature of the invention is that the mold flask is shaken to compact the sand around the mold pattern while the sand is being deposited into the mold flask. This provides sand compaction to higher sand pressure than is achieved with prior systems.

Another principal feature of the invention is that the mold pattern is held in the mold flask by means attached to the distribution box for clampingly engaging the mold pattern.

Other features and advantages of the invention will become apparent to those skilled in the art upon review of the following detailed description, claims, and drawings.

DESCRIPTION OF THE DRAWINGS

The single drawing FIGURE is a side elevational view of a molding apparatus embodying the invention and adapted for use in the process of the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawing is a molding apparatus 10 embodying the invention, the molding apparatus 10 including a mold flask 12 adapted to contain a mold pattern and sand. Although the mold flask 12 could have various constructions, in the drawings it is shown as having a generally square base and four vertical walls. Also shown is a foam mold pattern 14 having a sprue 15 extending upwardly therefrom, the pattern 14 being contained in the mold flask 12 and surrounded by sand.

When the mold flask 12 contains sand, the mold flask 12 and the sand have a combined center of gravity. When the mold flask 12 is being filled with sand, the combined center of gravity moves, first down and then back up to the approximate mold flask center as sand is added. Therefore, the combined center of gravity will have high and low extreme locations.

The molding apparatus 10 also includes means 16 for shaking the mold flask 12 to compact the sand around the mold pattern 14. While various suitable means 16 could be used for this purpose, in the illustrated construction, the means 16 comprise a compaction table 17, a vibrator 18, a connecting arm 19 extending from the compaction table 17, and a connecting member 20 attached to the mold flask 12 and received in a slot in the connecting arm 19.

In the illustrated construction, the connecting arm 19 and the connecting member 20 are constructed such that only horizontal forces are transmitted to the mold flask 12, and the connecting arm 19 and connecting member 20 are positioned in a horizontal plane located between the high and low extreme locations of the combined center of gravity, so that the means 16 provides horizontal vibrational forces directed in a horizontal plane extending approximately through the combined center of gravity of the mold flask 12 and the sand.

Also shown in the drawing are air bags 21 for resiliently supporting the mold flask 12. The air bags 21 are not a part of the invention, and any suitable means could be used for supporting the mold flask 12 for vibrating movement.

The molding apparatus 10 further includes means 22 for depositing sand in a rainfall into the mold flask 12 to surround the mold pattern 14. While various suitable means 22 could be employed for this purpose, in the illustrated construction, the means 22 comprises a distribution box 23 positioned above the mold flask 12. The distribution box 23 includes means 24 for distributing sand evenly across the mold flask 12 at a controlled velocity. In the illustrated construction, the means 24 is a screen 26 in the bottom end of the distribution box 23. The sand is sifted through the screen 26 so that it falls in a rainfall, or evenly across the mold flask 12 at a controlled velocity. Such a distribution box 23 and screen 26 are conventional and will not be described in greater detail herein.

Also illustrated in the drawing is a batch hopper 28 positioned above the distribution box 23. the batch hopper 28 is adapted to contain sand and includes selectively operable means 30 for depositing sand into the distribution box 23. These means 30 could be, for example, a sliding door 32 in the bottom end of the batch hopper 28, as shown in the drawing. The batch hopper 28 and the selectively operable means 30 are also conventional and will not be described in further detail herein.

The molding apparatus 10 further includes means 34 for holding the mold pattern 14 in a relatively stationary position in the mold flask 12. While other means 34 could be employed, in the preferred embodiment, such means 34 include means 36 attached to the distribution box 23 for releasably clampingly engaging the mold pattern sprue 15. While various suitable clamping means 36 could be employed, in the illustrated construction, the means 36 comprise a generally rigid cylindrical tube 37 attached to the distribution box 23 and extending downwardly therefrom. The lower end of the tube 37 encircles the upper end of the mold pattern sprue 15 and is releasably secured thereto by spring clips.

Referring now to the process of the invention, the mold pattern sprue 15 is first inserted into the tube 37 which is attached to the distribution box 23. Thereafter, the distribution box 23 and the releasably attached mold pattern 14 are lowered so that the mold pattern 14 is in position in the mold flask 12.

Therafter, sand is deposited into the mold flask 12 to surround the mold pattern 14. A batch of sand to be used in the process is contained in the batch hopper 28. By selectively opening the sliding door 32 in the bottom end of the batch hopper 28, the desired quantity of sand can be deposited into the distribution box 23. The sand flows into the mold flask 12 through the screen 26 in the bottom end of the distribution box 23, the screen 26 causing the sand to be distributed evenly across the mold flask 12 at a controlled velocity.

The mold flask 12 is shaken to compact the sand around the mold pattern 14 while the sand is being deposited into the mold flask 12. The mold flask 12 is shaken by the shaking means 16. Operation of the shaking means 16 while the sand is being deposited into the mold flask 12 provides improved compaction of the sand around the mold pattern 14.

Finally, before the apparatus 10 is ready for casting, the distribution box 23 is raised, with the spring clips in the tube 37 being such that the sand compacted around the mold pattern 14 holds the mold pattern 14 in place, and such that the mold pattern sprue 15 is separated from the tube 37.

Various of the features of the invention are set forth in the following claims.

We claim:

1. A process for inserting a mold pattern into sand for casting, said process comprising the steps of holding a mold pattern in a mold flask in unconnected relation to the mold flask, depositing sand into the mold flask to surround the mold pattern, and shaking the mold flask to compact the sand around the mold pattern while the sand is being deposited into the mold flask.

2. A process for inserting a mold pattern into sand for casting, said process comprising the steps of holding a mold pattern in a mold flask in unconnected relation to the mold flask, depositing sand in a rainfall into the mold flask to surround the mold pattern, and shaking the mold flask to compact the sand around the mold pattern while the sand is being deposited into the mold flask.

3. A process in accordance with claim 2 wherein the step of depositing sand in a rainfall includes the step of distributing the sand evenly across the mold flask at a controlled velocity.

4. A process in accordance with claim 2 wherein the mold flask, when containing sand, has a combined center of gravity, and wherein the shaking step includes the step of shaking the mold flask as a whole body with horizontal vibrational forces directed in a horizontal plane extending approximately through the combined center of gravity.

5. A process in accordance with claim 4 wherein a distribution box is positioned above the mold flask for depositing sand into the mold flask to surround the mold pattern, and wherein the holding step includes the step of holding the mold pattern by means attached to the distribution box and releasably clamped to the mold pattern.

6. A process for inserting a mold pattern into sand for casting, said process comprising the steps of providing a mold flask which, when containing sand, has a combined center of gravity, and a distribution box positioned above the mold flask for depositing sand into the mold flask to surround the mold pattern, holding the mold pattern in the mold flask by means attached to the distribution box and releasably clamped to the mold pattern, depositing sand in a rainfall into the mold flask to surround the mold pattern, said step of depositing sand in a rainfall including the step of distributing the sand evenly across the mold flask at a controlled velocity, and shaking the mold flask as a whole body with horizontal vibrational forces directed in a horizontal plane extending approximately through the combined center of gravity to compact the sand around the mold pattern while the sand is being deposited into the mold flask.

7. A molding apparatus comprising a mold flask adapted to contain a mold pattern and sand, means independent of said mold flask for holding a mold pattern in position in said mold flask, means for depositing sand into said mold flask to surround the mold pattern, and means for shaking said mold flask to compact the sand around the mold pattern while the sand is being deposited into said mold flask.

8. A molding apparatus comprising a mold flask adapted to contain a mold pattern and sand, means independent of said mold flask for holding a mold pattern in position in said mold flask, means for depositing sand in a rainfall into said mold falsk to surround the mold pattern, and means for shaking said mold flask to compact the sand around the mold pattern while the sand is being deposited into said mold flask.

9. A molding apparatus in accordance with claim 8 wherein said mold flask, when containing sand, has a combined center of gravity, and wherein said means for shaking said mold flask shakes said mold flask as a whole body and provides horizontal vibrational forces directed in a horizontal plane extending approximately through the combined center of gravity.

10. A molding apparatus in accordance with claim 8 wherein said means for depositing sand in a rainfall distributes sand evenly across said mold flask at a controlled velocity.

11. A molding apparatus in accordance with claim 8 wherein said means for depositing sand in a rainfall includes a distribution box positioned above said mold flask, and wherein said means for holding the mold pattern includes means attached to said distribution box and releasably clamped to the mold pattern.

12. A molding apparatus in accordance with claim 11 wherein said distribution box includes means for distributing sand evenly across said mold flask at a controlled velocity.

13. A molding apparatus in accordance with claim 12 wherein said distribution box has a bottom end and wherein said means for distributing sand is a screen in said bottom end.

14. A molding apparatus in accordance with claim 13 and further comprising a batch hopper positoned above said distribution box, said batch hopper being adapted to contain sand and including selectively operable means for depositing sand into said distribution box.

15. A molding apparatus in accordance with claim 14 wherein said mold flask, when containing sand, has a combined center of gravity, and wherein said means for shaking said mold flask shakes said mold flask as a whole body and provides horizontal vibrational forces directed in a horizontal plane extending approximately through the combined center of gravity.

16. A molding apparatus comprising a mold flask adapted to contain a mold pattern and sand, and, when containing sand, having a combined center of gravity, means for depositing sand in a rainfall into said mold flask to surround the mold pattern, said means distributing sand evenly across said mold flask at a controlled velocity comprising a distribution box positioned above said mold flask and having a bottom end and a screen in said bottom end, and a batch hopper positioned above said distribution box and adapted to contain sand, said batch hopper including selectively operable means for depositing sand into said distribution box, means attached to said distribution box for holding the mold pattern in position in said mold flask, and means providing horizontal vibrational forces directed in a horizontal plane extending approximately through the combined center of gravity of said mold flask for shaking said mold flask as a whole body to compact the sand around the mold pattern.

* * * * *